US007889872B2

(12) United States Patent
Bai et al.

(10) Patent No.: US 7,889,872 B2
(45) Date of Patent: Feb. 15, 2011

(54) DEVICE AND METHOD FOR INTEGRATING SOUND EFFECT PROCESSING AND ACTIVE NOISE CONTROL

(75) Inventors: Mingsian R. Bai, Hsinchu (TW); Kuen-Ying Ou, Taichung (TW); Jain-Liang Lin, Tainan (TW)

(73) Assignee: National Chiao Tung University, Hsinchu (TW)

( * ) Notice: Subject to any disclaimer, the term of this patent is extended or adjusted under 35 U.S.C. 154(b) by 1358 days.

(21) Appl. No.: 11/362,850

(22) Filed: Feb. 28, 2006

(65) Prior Publication Data

US 2007/0121956 A1 May 31, 2007

(51) Int. Cl.
*H04R 29/00* (2006.01)
*H04R 5/02* (2006.01)

(52) U.S. Cl. ..... 381/59; 381/309; 381/96

(58) Field of Classification Search ..... 381/309, 381/59, 63, 95, 96, 71.6, 61, 1, 17–18
See application file for complete search history.

(56) References Cited

U.S. PATENT DOCUMENTS

| | | | | |
|---|---|---|---|---|
| 5,105,462 | A | 4/1992 | Lowe et al. | |
| 5,173,944 | A | 12/1992 | Begault | |
| 5,371,799 | A | 12/1994 | Lowe et al. | |
| 5,440,639 | A | 8/1995 | Suzuki et al. | |
| 5,761,314 | A * | 6/1998 | Inanaga et al. | 381/17 |
| 7,110,800 | B2 * | 9/2006 | Nagayasu et al. | 455/575.2 |

FOREIGN PATENT DOCUMENTS

| | | |
|---|---|---|
| TW | 337396 | 3/1986 |
| TW | 391149 | 1/1987 |
| TW | 444511 | 4/1987 |
| TW | 364947 | 1/1988 |
| TW | 437258 | 9/1988 |
| TW | 546982 | 6/1991 |
| TW | 560217 | 6/1991 |
| TW | 562382 | 9/1991 |
| TW | 595238 | 5/1992 |

(Continued)

OTHER PUBLICATIONS

Mingsian Bai and Dunjay Lee, "Implementation of an active headset by using the H robus control theory", J. Acoust. Soc. Am. 102(4), Oct. 1997.

(Continued)

*Primary Examiner*—Xu Mei
(74) *Attorney, Agent, or Firm*—Rosenberg, Klein & Lee

(57) ABSTRACT

A device and a method for integrating 3D sound effect processing and active noise control are proposed. A digital signal processor incorporates an artificial reverberator and a 3D spatial audio processor into an audio module. The audio signal is presented via an earphone. Next, a microphone embedded in the vicinity of the loudspeaker inside the headset is used to sense an external noise while playing, and feed it back to an active noise controller, which generates an anti-noise to eliminate the external noise. Therefore, the signal to noise ratio can be increased and the 3D sound field effect can be significantly enhanced. In addition, a head-related transfer function is more efficiently implemented on the basis of an interaural transfer function in the spatial audio processing to reduce the filter order lower and hence the computation loading.

8 Claims, 6 Drawing Sheets

FOREIGN PATENT DOCUMENTS

TW 519849 12/2000

OTHER PUBLICATIONS

J. Mackenzie, J. Huopaniemi, V. Valimaki, and I. Kale, "Low order Modeling of Head-Related Transfer Functions using Balanced Model Truncation", IEEE Signal Processing Letters 4 (2) (1997) 39-41.

A. Kulkarni and H.S. Colburn, "Infinite-impulse-response models of the head-related transfer function", J. Acoust. Soc. Am 115 (4) (2004) 1714-1728.

F.P. Freeland, L. W.P. Biscainho, and P.S.R. Diniz, Interpositional Transfer Function for 3D-Sound Generation, J. Audio Eng. Soc. 52 (9) (2004) 915-930.

* cited by examiner

DEVICE AND METHOD FOR INTEGRATING SOUND EFFECT PROCESSING AND ACTIVE NOISE CONTROL

BACKGROUND OF THE INVENTION

1. Field of the Invention

The present invention relates to a device and a method for active noise control and, more particularly, to a device and a method for integrating 3D sound effect processing and active noise control.

2. Description of Related Art

Nowadays, using an audio system to listen to music, to watch movie or to listen to the radio has become a popular entertainment of people. Earphones, home loudspeakers, car audios, and so on are commonly used in everyday life of people. In addition to the function of audio playback, an ordinary earphone also performs active noise control to the received noise from outside at the same time when the user listens to music so as to provide better sound effects. The control methods can be categorized into two types: passive and active. In the passive type noise control method, sound isolating material is used to block outside interference. Therefore, the earphone is deemed as bulky and performs badly in isolating low-frequency noise. Because the active control method does not suffer from the above limitation, earphones with built-in active noise control are more attractive solutions to consumers in the market.

Owing to recent advances of signal processing techniques, various kinds of active noise control systems have been continually proposed. Prior art generally requires one or a set of loudspeakers to generate a noise canceling signal. The noise canceling signal is calculated through the noise source and the error signal. For instance, Taiwan Pat. No. 562,382 disclosed a feedback active noise control earphone, which produces a sound wave signal having the same amplitude and the opposite phase with an environment noise to eliminate the environment noise. Besides, Taiwan Pat. No. 364,947 disclosed a noise control system, which gives out an interference sound wave to counteract noise and disturbances. Although the above methods can suppress noise interference, they cannot further improve and process the playback quality of sound source signals to provide the best hearing effects for users.

Accordingly, the present invention aims to propose a device and a method for effectively integrating active noise control and 3D sound effect processing to solve the above problems encountered in the prior art. Moreover, the proposed device and method can apply to various kinds of sound effect playback devices.

SUMMARY OF THE INVENTION

An object of the present invention is to provide a device and a method for integrating noise control and sound effect processing, in which an anti-noise is used to counteract the interference of external noise. Moreover, digital signal processing techniques are used to generate sensation of localization and spaciousness of the sound field so as to enhance the depth, breadth, and reverberation of sound, hence providing an immersive quality spatial sound for users.

Another object of the present invention is to provide a device and a method for integrating active noise control and sound effect processing, which adjust the control structure according to different scenarios to apply to various kinds of sound effect playback devices.

Yet another object of the present invention is to provide a device and a method for integrating active noise control and sound effect processing, which can accomplish the control instantaneously. The device and method performs 3D audio processing by means of digital signal processing, and replace digital circuits with analog circuits to realize active noise control so as to avoid any time delay between input signal and output signal, thereby accomplishing the effect instantaneously.

Yet another object of the present invention is to provide a device and a method for integrating noise control and sound effect processing, which can reduce the amounts of operations and stored coefficients, and also disclose a new embodiment of the head-related transfer function (HRTF). The HRTF is replaced with an interaural transfer function (ITF) representing the difference of head transfer functions between two ears to more clearly and more efficiently reproduce the sensation of localization of sound source.

Yet another object of the present invention is to provide an expression of the interaural transfer function (ITF) based on finite impulse response (FIR), which utilizes the Wiener filter to design the FIR filter for the ITF and ignores sound frequencies that human cannot hear so as to accomplish a low order and simplified filter design, hence enhancing the application level and performance.

The present invention can easily be built in sound effect card chips or sound effect systems provided by the Windows operation system.

To achieve the above objects, the present invention first performs 3D sound effect processing to an input audio signal to reproduce the sensation of localization and spaciousness of sound. Next, the processed audio signal is input to a noise control and a sound player to be played out. A sensor in the sound player is then used to detect an external noise at the same time when the audio signal is played. Subsequently, the external noise is fed back to the noise controller to cancel the received external noise. Users can thus hear the audio signal that has undergone sound effect processing and has no interference of external noise.

BRIEF DESCRIPTION OF THE DRAWINGS

The various objects and advantages of the present invention will be more readily understood from the following detailed description when read in conjunction with the appended drawing, in which.

DETAILED DESCRIPTION OF THE PREFERRED EMBODIMENTS

The present invention proposes a device and a method for integrating 3D sound effect processing and active noise control. In addition to using a digital signal processor to perform 3D spatial positioning of sound, the present invention also utilizes a sensor to receive an external noise at the same time when playing an audio signal. The external noise is fed back to a noise controller to generate an anti-noise signal for canceling out the external noise. The audio signal played by a loudspeaker is therefore one that has undergone sound effect processing and has no interference of external noise.

Figure 1:
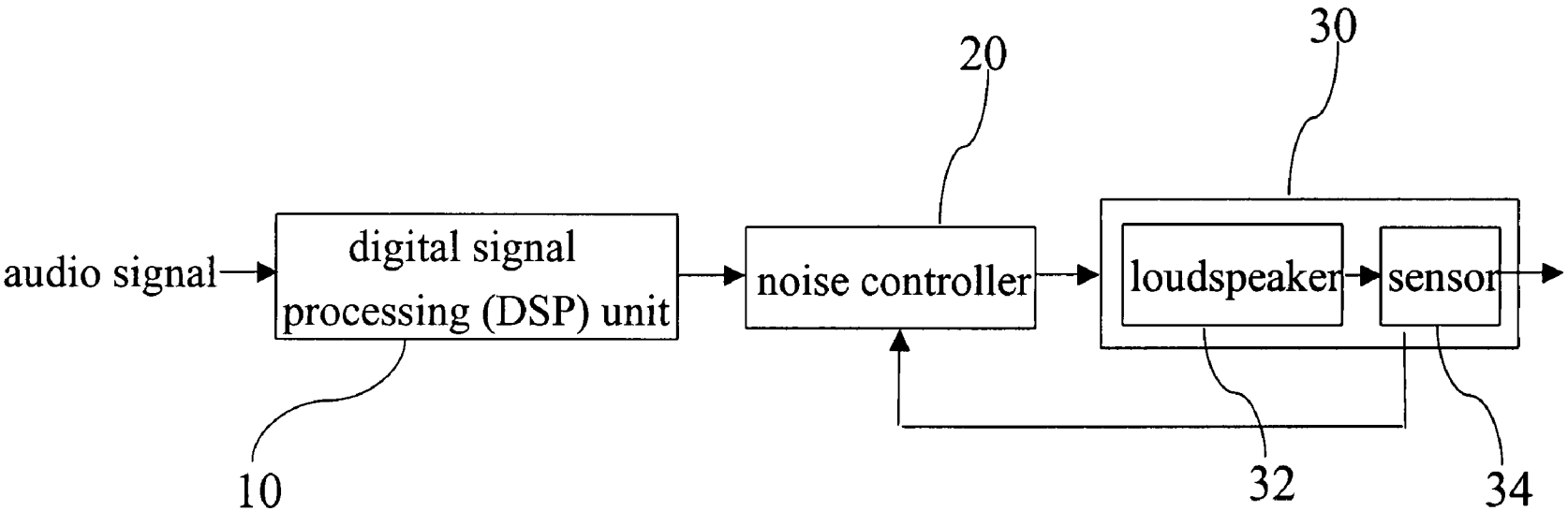
FIG. 1 is a diagram of a device for integrating noise control and sound effect processing of the present invention.

As shown in FIG. 1, the present invention comprises a digital signal processor 10, a sound player 30 and a noise controller 20. The digital signal processor 10 performs reverberation and 3D spatial positioning to audio signals. The sound player 30 is used to play the audio signal. The noise controller 20 is used for noise elimination. When an audio signal is input to the digital signal processor 10, the digital signal processor 10 first performs sound field positioning by techniques for simulating 3D sound and simulates different spatial responses through signal filtering to build a sound field with 3D spaciousness. After the digital signal processor 10 has finished sound effect processing of the audio signal, the audio signal is sent to the sound player 30. The sound player 30 comprises a loudspeaker 32 and a sensor 34. The sensor 34 can be a microphone, and is installed in front of the loudspeaker 32. After receiving the audio signal processed by the digital signal processor 10, the audio signal is played out via the loudspeaker 32. But at the same time when playing the audio signal, the user will hear an external noise. In order to eliminate noise interference so that the user can successfully hear the original sound, the sensor 34 will send the detected audio signal with the external noise attached thereto to the noise controller 20. After comparing with the original audio signal, the external noise can be obtained. The noise controller 20 then produces an anti-noise signal according to the comparison result to eliminate the external noise. Therefore, the sound signal output from the noise controller 20 to the loudspeaker 32 and finally heard by the user has undergone sound effect processing and noise elimination. This sound signal not only has sensation of localization and spaciousness of sound field, but has also enhanced sound depth, breadth, and reverberation degree. An immersive quality spatial sound can thus provided for the user.

Figure 2:
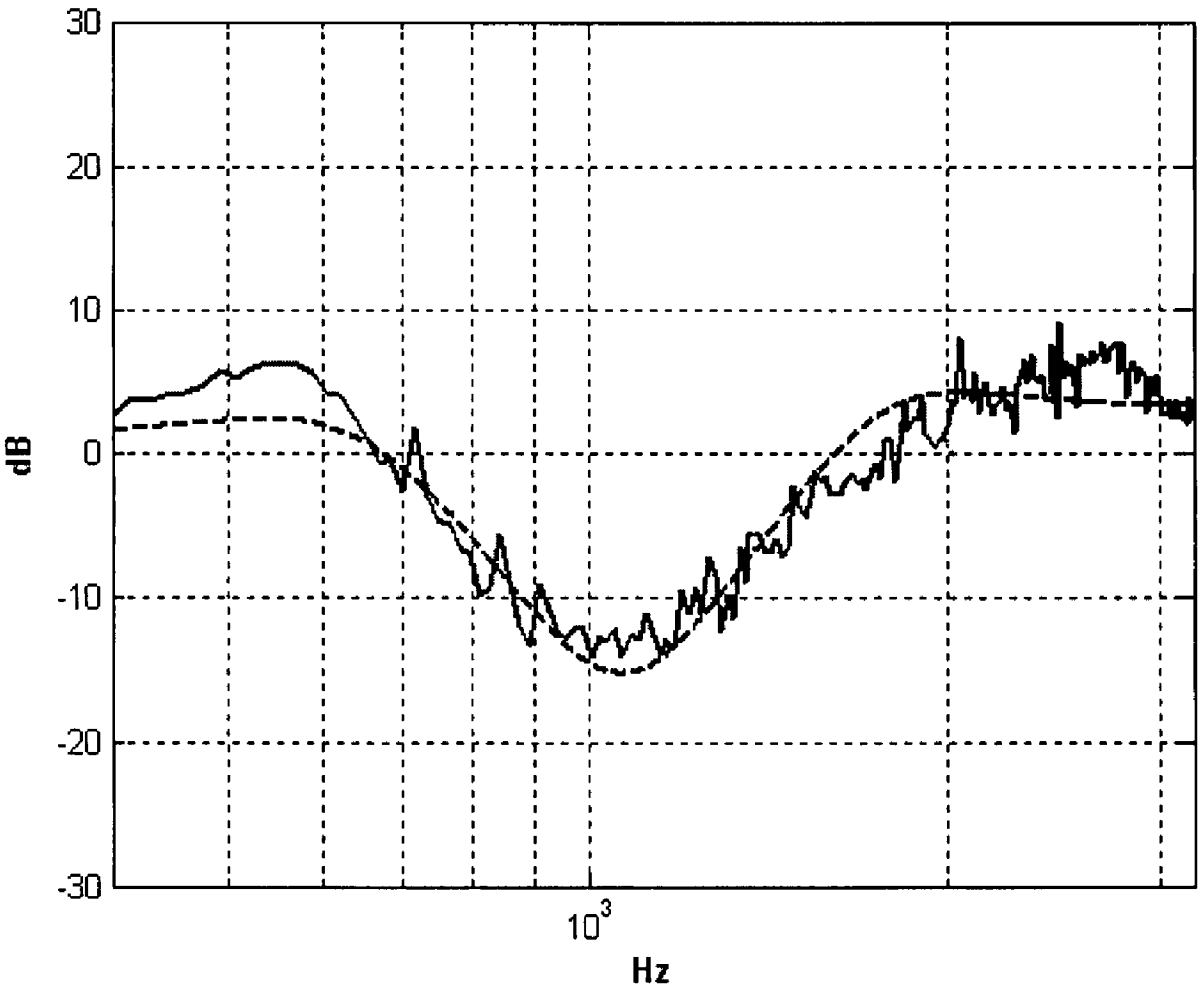
FIG. 2 shows a simulation result of noise control when the present invention is applied to an earphone device.

The noise controller 20 is based on the quantitative feedback theory (QFT), and is designed for the specification of the sound player 30. The noise controller 20 quantizes the uncertainty and specification tolerance of the sound player 30 by means of feedback to achieve the expected noise control performance. The present invention can therefore design the noise controller 20 according to different scenarios to apply to various kinds of sound effect playback devices such as earphones and mobile phones. FIG. 2 shows a simulation result of noise control when the present invention is applied to an earphone device. In FIG. 2, the dashed line represents the designed theoretic values, while the solid line represents the experiment results. From the simulation result, we know that the device for integrating sound effect processing and active noise control disclosed in the present invention has a noise reduction capability of 10 dB at the frequency band of 700 Hz~2 kHz.

Moreover, the present invention makes use of digital circuits for 3D audio processing, and utilizes a feedback control system formed by cascaded analog circuits to replace digital circuits so as to realize active noise control. Therefore, any time delay between input signal and output signal can be avoided to accomplish the effect of realtime control.

Figure 3:
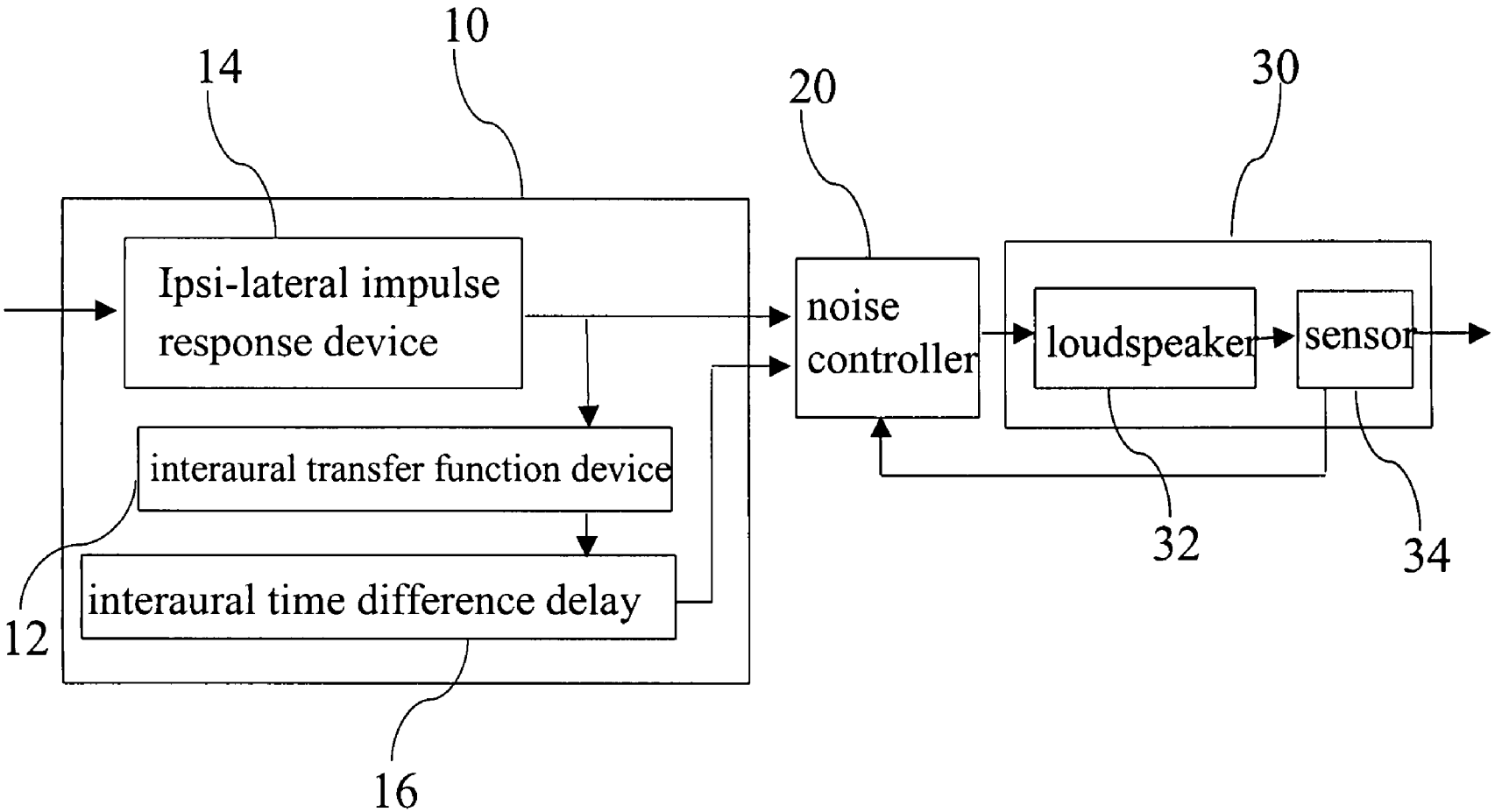
FIG. 3 is a diagram of a device for integrating noise control and sound effect processing according to another embodiment of the present invention.
Figure 4:
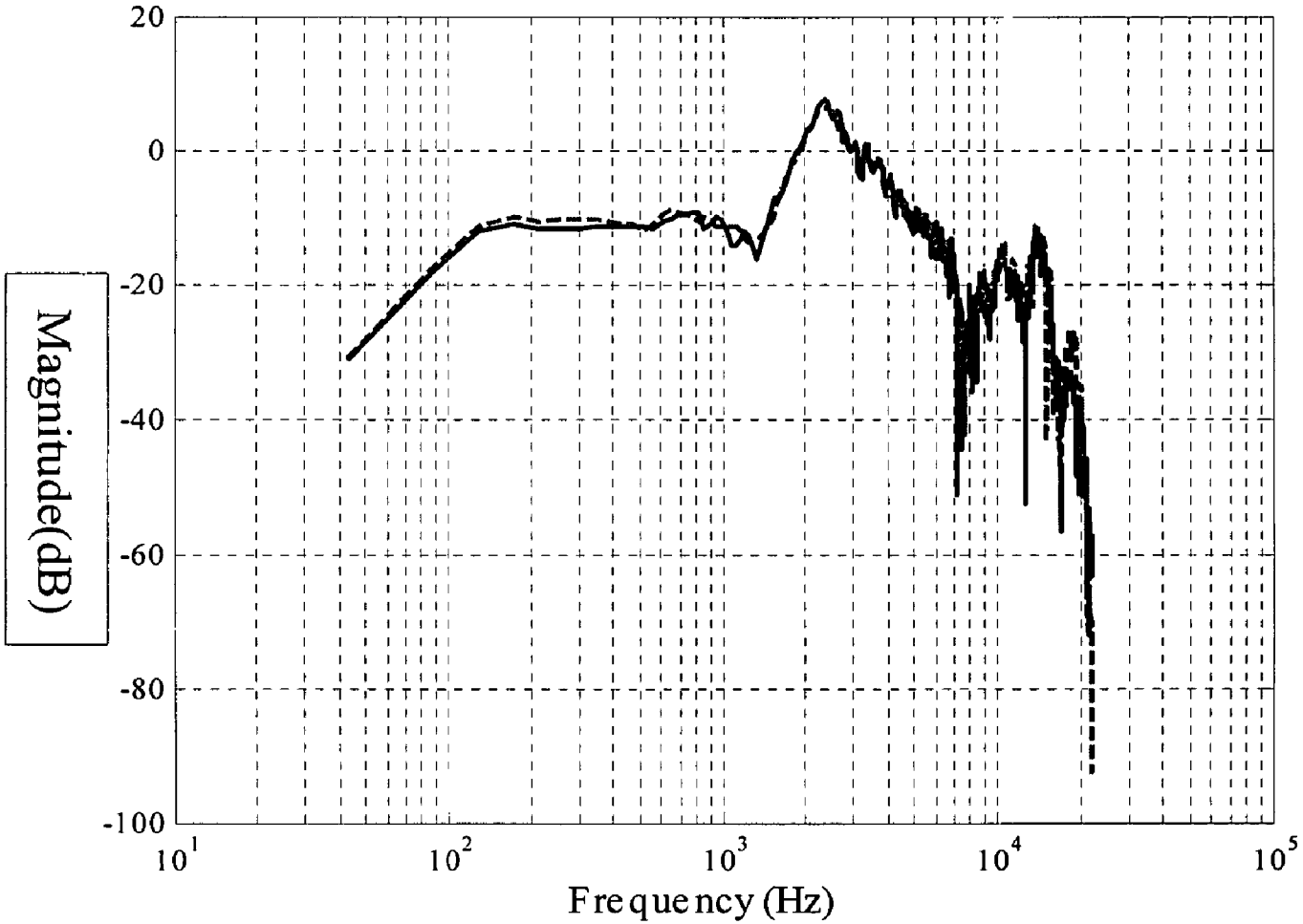
FIG. 4 is a comparison diagram of the interaural transfer function and the head-related transfer function at a horizontal angle of 45 degrees.
Figure 5:
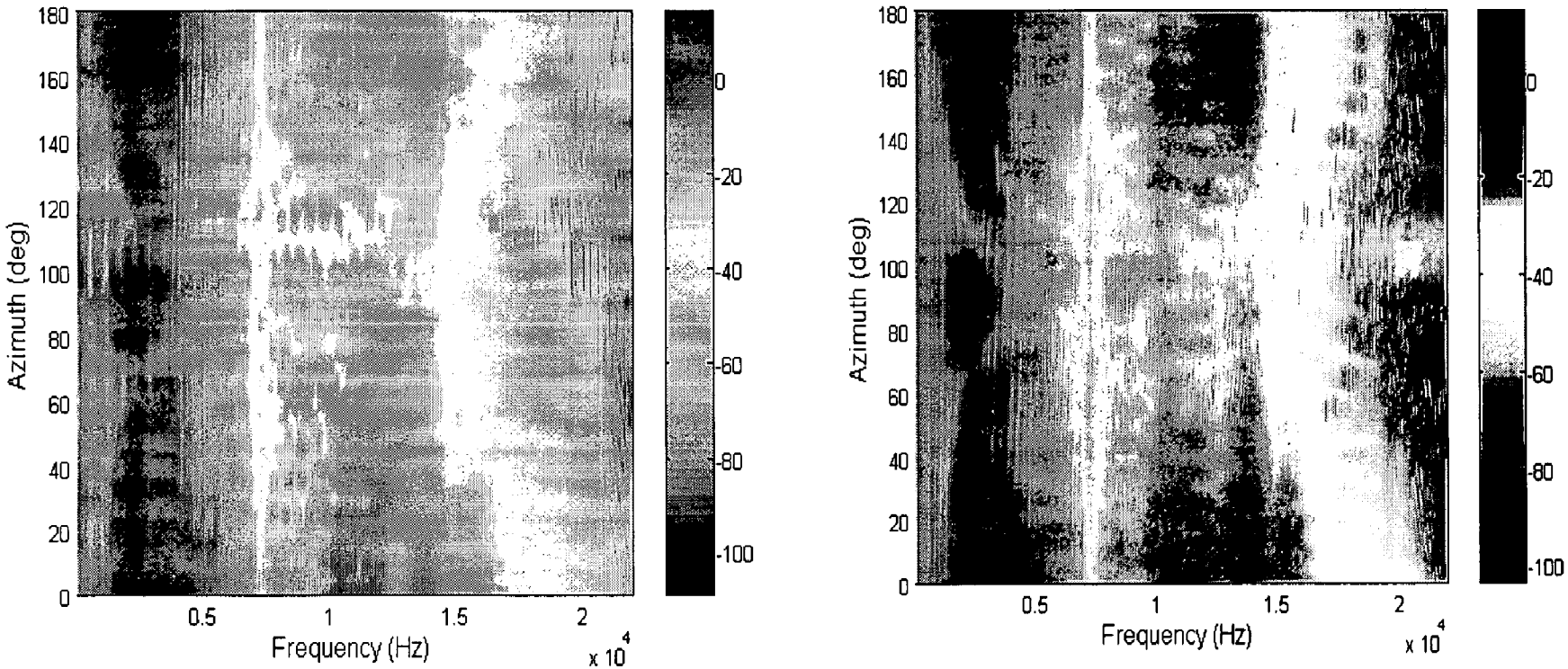
FIG. 5 is a comparison diagram of the interaural transfer function and the head-related transfer function at all horizontal angles.
Figure 6:
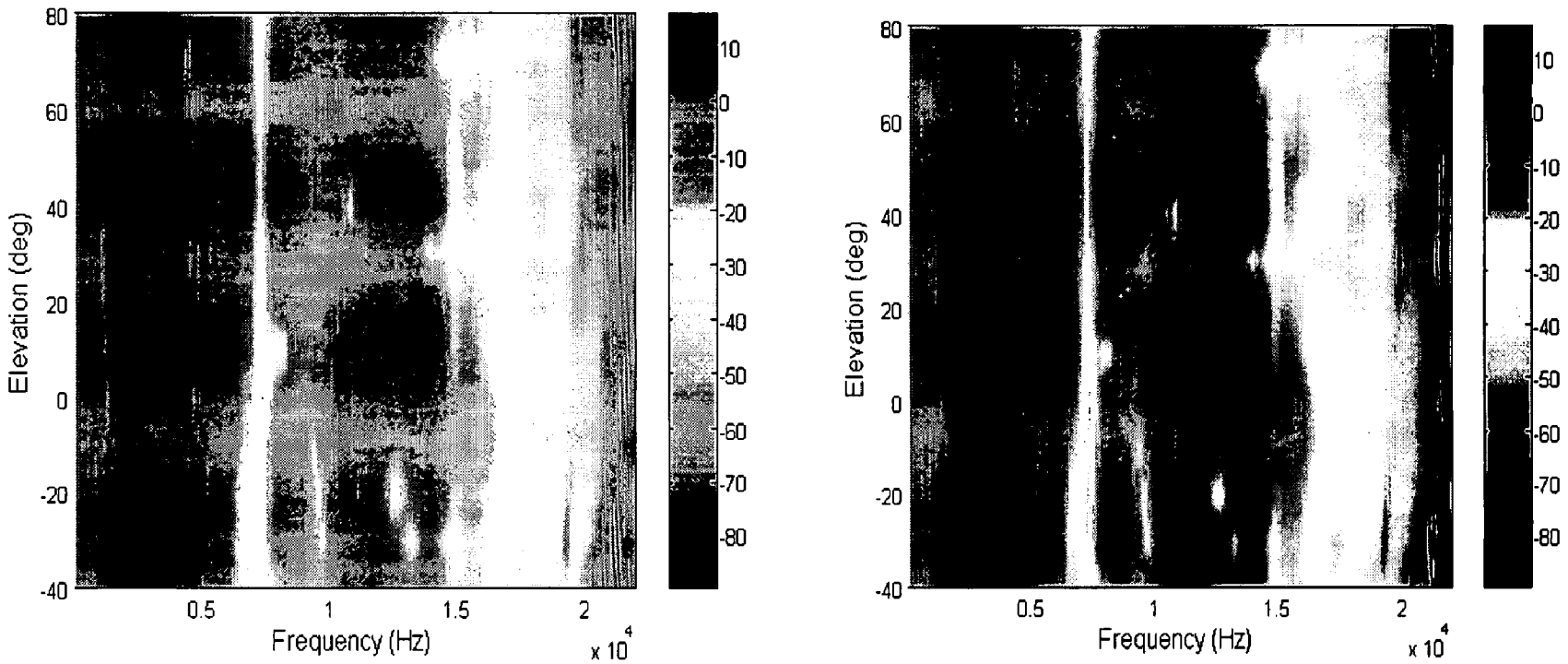
FIG. 6 is a comparison diagram of the interaural transfer function and the head-related transfer function at all elevation angles.

FIG. 3 shows another embodiment of the present invention based on the HRTF to perform sound positioning processing, in which the head position of the user is assumed to be fixed. The system from the sound source through the external ear to the ear drum can be viewed as a linear time-invariant system having an impulse response in the time domain or a transfer function in the frequency domain that can represent the system characteristics. The transfer function is called the head-related transfer function (HRTF). Owing to different distances from two ears to the sound source, the impulse response can be divided into an ipsi-lateral impulse response at the same side as the sound source and a contra-lateral impulse response at the opposite side of the sound source. Because directly using the measured HRTF for 3D spatial sound positioning requires a larger amount of stored coefficients and a larger amount of operations, the digital signal processor 10 of the present invention instead makes use of an interaural transfer function (i.e., the difference value between the ipsi-lateral impulse response and the contra-lateral impulse response) to replace the HRTF for sound positioning processing. As shown in FIG. 3, an audio signal is convoluted with a ipsi-lateral impulse response device 14 to obtain an ipsi-lateral output signal. The ipsi-lateral output signal is then converted by an interaural transfer function device 12. Next, a corresponding interaural time difference is added to the converted ipsi-lateral output signal by an interaural time difference delayer 16 to acquire a contra-lateral output signal. The realized structure of a lower-order finite impulse response filter of the interaural transfer function device 12 can be obtained by Wiener filter. The interaural transfer function device 12 is designed for only the audible frequency range of human (below 15 kHz) and ignores sound frequencies that human cannot hear, hence reducing unnecessary operations. Besides, it is only necessary for the sound positioning method to realize the ipsi-lateral system. The contra-lateral signal can be obtained by adding the difference value. As compared to the method which directly makes use of the HRTF for sound positioning processing, about a 40% amount of stored coefficients and operations can be saved for identical effects. The experiment results are shown in FIGS. 4 to 6. FIG. 4 is a comparison diagram of the interaural transfer function and the head-related transfer function at a horizontal angle of 45 degrees. FIG. 5 is a comparison diagram of the interaural transfer function and the head-related transfer function at all horizontal angles. FIG. 6 is a comparison diagram of the interaural transfer function and the head-related transfer function at all elevation angles. In the designed frequency range (below 15 kHz), the effects achieved are almost the same. As confirmed by the experiment results, the present invention can effectively reduce the complexity of operation without causing any distortion of sound quality.

Although the present invention has been described with reference to the preferred embodiment thereof, it will be understood that the invention is not limited to the details thereof. Various substitutions and modifications have been suggested in the foregoing description, and other will occur to those of ordinary skill in the art. Therefore, all such substitutions and modifications are intended to be embraced within the scope of the invention as defined in the appended claims.

We claim:

1. A device for integrating sound effect processing and noise control comprising:

a digital signal processor for performing reverberation and sound positioning processing to an input audio signal, said sound positioning processing including 3D sound effect processing of a head-related transfer function, said head-related transfer function being expressed by an interaural transfer function;

a sound player comprising a loudspeaker and a sensor disposed in front of said loudspeaker, said sound player receiving and playing said audio signal and using said sensor to detect said audio signal with an external noise attached thereto; and a noise controller connected to said digital signal processor and said sound player, said noise controller generating an anti-noise signal according to said audio signal with said external noise attached thereto to eliminate interference of said external noise to said audio signal;

wherein Wiener filter is used to obtain a realized structure of a lower-order finite impulse response filter of said interaural transfer function, and said realized structure is designed for the audible frequency range of humans, and ignores sound frequencies that are inaudible.

2. The device for integrating sound effect processing and noise control as claimed in claim 1, wherein said interaural transfer function is the difference value between an ipsi-lateral impulse response at the same side with the sound source and a contra-lateral impulse response at the other side of the sound source.

3. The device for integrating sound effect processing and noise control as claimed in claim 2, wherein using said interaural transfer function to express said head-related transfer function comprises the steps of:

convoluting said audio signal with said ipsi-lateral impulse response to obtain an ipsi-lateral output signal; and using said interaural transfer function to convert said ipsi-lateral output signal and adding a corresponding interaural time difference to obtain a contra-lateral output signal.

4. The device for integrating sound effect processing and noise control as claimed in claim 1, wherein said noise controller is based on quantitative feedback theory (QFT), and is designed for the specification of said sound player.

5. The device for integrating sound effect processing and noise control as claimed in claim 1, wherein said device is applied to earphones and mobile phones.

6. A method for integrating sound effect processing and noise control comprising the steps of:

inputting an audio signal;

performing reverberation and sound positioning processing to said audio signal, said sound positioning processing including 3D sound effect processing of a head-related transfer function, said head-related transfer function being expressed by an interaural transfer function;

playing said audio signal by a sound player;

using a sensor in said sound player to receive said audio signal and the simultaneous external noise when playing;

transferring said audio signal with said external noise attached thereto to a noise controller;

using said noise controller to generating an anti-noise signal to eliminate interference of said external noise; and using said sound player to play said audio signal with said external noise already eliminated;

wherein Wiener filter is used to obtain a realized structure of a lower-order finite impulse response filter of said interaural transfer function, and said realized structure is designed for the audible frequency range of humans, and ignores sound frequencies that are inaudible.

7. The method for integrating sound effect processing and noise control as claimed in claim 6, wherein said interaural transfer function is the difference value between an ipsi-lateral impulse response at the same side with the sound source and a contra-lateral impulse response at the other side of the sound source.

8. The method for integrating sound effect processing and noise control as claimed in claim 7, wherein using said interaural transfer function to express said head-related transfer function comprises the steps of:

convoluting said audio signal with said ipsi-lateral impulse response to obtain a ipsi-lateral output signal; and using said interaural transfer function to convert said ipsi-lateral output signal and adding a corresponding interaural time difference to obtain a contra-lateral output signal.

* * * * *